US007113568B2

(12) United States Patent
Vadari et al.

(10) Patent No.: US 7,113,568 B2
(45) Date of Patent: Sep. 26, 2006

(54) LIQUID COOLED BEARING HOUSING WITH GREASED LUBRICATED ROTATING ANODE BEARINGS FOR AN X-RAY TUBE

(75) Inventors: Harith Vadari, Karnataka (IN); Mandyam Rangayan Sridhar, Karnataka (IN); Mayank Tiwari, Karnataka (IN)

(73) Assignee: General Electric Company, Schnectady, NY (US)

( * ) Notice: Subject to any disclaimer, the term of this patent is extended or adjusted under 35 U.S.C. 154(b) by 0 days.

(21) Appl. No.: 10/905,701

(22) Filed: Jan. 18, 2005

(65) Prior Publication Data

US 2006/0159228 A1 Jul. 20, 2006

(51) Int. Cl.
*H01J 35/10* (2006.01)

(52) U.S. Cl. ..... 378/132; 378/130; 378/131; 378/133

(58) Field of Classification Search ..... 378/4, 378/15, 121, 125, 131, 142, 143, 199, 210, 378/129, 130, 132, 133, 144, 200
See application file for complete search history.

(56) References Cited

U.S. PATENT DOCUMENTS

| | | | | |
|---|---|---|---|---|
| 2,754,168 | A * | 7/1956 | Atlee | 445/28 |
| 4,357,555 | A * | 11/1982 | Gerkema et al. | 378/135 |
| 4,856,039 | A * | 8/1989 | Roelandse et al. | 378/133 |
| 5,077,781 | A * | 12/1991 | Iversen | 378/200 |
| 6,295,338 | B1 * | 9/2001 | Kuzniar et al. | 378/132 |
| 6,751,291 | B1 * | 6/2004 | Nakamuta et al. | 378/132 |
| 2002/0085675 | A1 * | 7/2002 | Snyder et al. | 378/130 |
| 2004/0240614 | A1 * | 12/2004 | Tiwari et al. | 378/131 |

* cited by examiner

*Primary Examiner*—Edward J. Glick
*Assistant Examiner*—Anastasia S. Midkiff
(74) *Attorney, Agent, or Firm*—Peter J. Vogel

(57) ABSTRACT

A rotating anode bearing housing includes an x-ray tube frame (106) that has a vacuum chamber (108). An anode (110) resides within the vacuum chamber (108) and rotates on a shaft (114) via a bearing (117). The bearing (117) is attached to an interior surface (126) of the x-ray tube frame (106). The bearing (117) transfers thermal energy from the shaft (114) to the x-ray tube frame (106).

22 Claims, 5 Drawing Sheets

LIQUID COOLED BEARING HOUSING WITH GREASED LUBRICATED ROTATING ANODE BEARINGS FOR AN X-RAY TUBE

TECHNICAL FIELD

The present invention relates generally to x-ray imaging systems and to cooling techniques thereof. More particularly, the present invention relates to a system for cooling the bearings of a rotating anode within an x-ray tube.

BACKGROUND OF THE INVENTION

An x-ray imaging system that contains an x-ray tube, such as a CT imaging system, typically includes a gantry that rotates at various speeds in order to create a 360° image. The gantry contains an x-ray source, such as an x-ray tube, that generates x-rays by electron bombardment on an anode with a high-energy electron beam. The electron beam originates from a cathode that is physically separated from the anode by a vacuum gap. The anode has a target that is coupled to a shaft, which rotates via a motor on one or more pairs of anode bearings. X-rays are emitted from the target and are projected in the form of a fan-shaped beam. The x-ray beam passes through the object being imaged, such as a patient. The beam, after being attenuated by the object, impinges upon an array of radiation detectors. Each detector element of the array produces a separate electrical signal that is a measurement of the beam attenuation at the detector location. The attenuation measurements from all the detectors are acquired separately to produce a transmission profile for the generation of an image.

It is desirable to increase gantry rotating speeds and x-ray tube peak and average operating power such that faster imaging times and improved image quality can be provided. With increased gantry rotational speed comes increased mechanical load on the x-ray tube bearings and with increased peak and average operating power comes increased thermal load on the x-ray tube bearings.

Current x-ray tubes often have a frame that is enclosed within an insert. The interior of the frame is under a high vacuum. An oil bath resides between the frame and the insert. The oil bath is utilized to cool the frame. Thermal energy radiates, through the vacuum chamber, from the rotating anode bearings to the frame. The thermal energy is then passed from the frame into the oil bath. The heated oil is cooled by the circulation thereof through a heat exchanger. Thermal energy in the oil is transferred in the heat exchanger to ambient air, or, alternatively, a coolant, which circulates to and from an external chiller.

Traditionally, the anode bearings include ball bearings and bearing race, which reside within a stationary bearing housing. An outer bearing race is assembled onto the stationary housing and an inner bearing race is assembled onto the rotating shaft. The bearings are silver or lead lubricated. Silver or lead is used due to its adhering characteristics to prevent the lubricant from being released within the vacuum chamber and causing degradation to the operating performance of the x-ray tube. Silver and lead lubricants remain on the bearings and reduce the friction between the bearing balls and the bearing race. The bearing race are typically coupled to the inner walls of the bearing housing and thermal energy within the bearings is radiated through the bearing housing, the electrical motor rotor that resides over the bearing housing, multiple vacuum chamber areas, and into the frame whereupon it is transferred to the oil bath. This method of cooling and lubricating the rotating anode bearings to reduce the operating temperatures and the friction between the bearing balls and the bearing race is inadequate for increased peak and average operating power and increased gantry rotating speeds.

In addition to the desired higher gantry operating loads and the higher peak and average operating powers it is also desirable to increase the life of x-ray tube bearings. Thus, there exists a need for an improved technique of reducing the operating temperatures of the rotating anode bearings and of lubricating the anode bearings to allow for increased gantry loads, increased peak and average operating powers, and improved overall bearing performance.

SUMMARY OF THE INVENTION

The present invention provides a rotating anode bearing housing that includes an x-ray tube frame that has a vacuum chamber. An anode resides within the vacuum chamber and rotates on a shaft via a bearing. The bearing is attached to an interior surface of the x-ray tube frame. The bearing transfers thermal energy from the shaft to the x-ray tube frame.

The embodiments of the present invention provide several advantages. One such advantage is the provision of a continuous and short thermal energy conduction path between a rotating anode and an x-ray tube frame through the bearings of the rotating anode. This conduction path increases the thermal energy transfer efficiency between the anode and the x-ray tube frame and reduces the operating temperatures of the anode and the bearings.

Another advantage provided by an embodiment of the present invention is the provision of attaching rotating anode bearings to an x-ray tube frame for direct cooling thereof. This also increases thermal energy transfer efficiency and reduces operating temperatures of the bearings.

In addition, another advantage provided by an embodiment of the present invention is the provision of using a liquid metal, such as gallium or a gallium alloy, in the bearing housing, which performs as a thermal shunt and further enhances thermal energy transfer efficiency and reduces operating temperatures of the bearings. The direct coupling of the rotating anode bearings to the x-ray tube frame and the incorporation of liquid metal coolant in the bearing housing allows for the lubrication of the rotating anode bearings with vacuum grease. The use of a grease lubricant increases the operating life of the bearings and allows for increased gantry rotating speeds and increased thermal loads to be applied on the bearings.

Yet another advantage provided by an embodiment of the present invention, is the use of a motor rotor and other motor components attached and/or coupled to an aft end of a rotating anode shaft. By coupling the motor components to the end of the shaft, distance between the anode and the motor are increased. This increase in motor component and anode separation distance decreases the operating temperatures of the motor components and thus increases the operating life of the motor.

Furthermore, the above-described advantages separately and in combination provide improved x-ray tube performance, reliability, and robustness.

The present invention itself, together with attendant advantages, will be best understood by reference to the following detailed description, taken in conjunction with the accompanying figures.

BRIEF DESCRIPTION OF THE DRAWINGS

For a more complete understanding of this invention reference should now be had to the embodiments illustrated in greater detail in the accompanying figures and described below by way of examples of the invention wherein.

DETAILED DESCRIPTION

Figure 1:
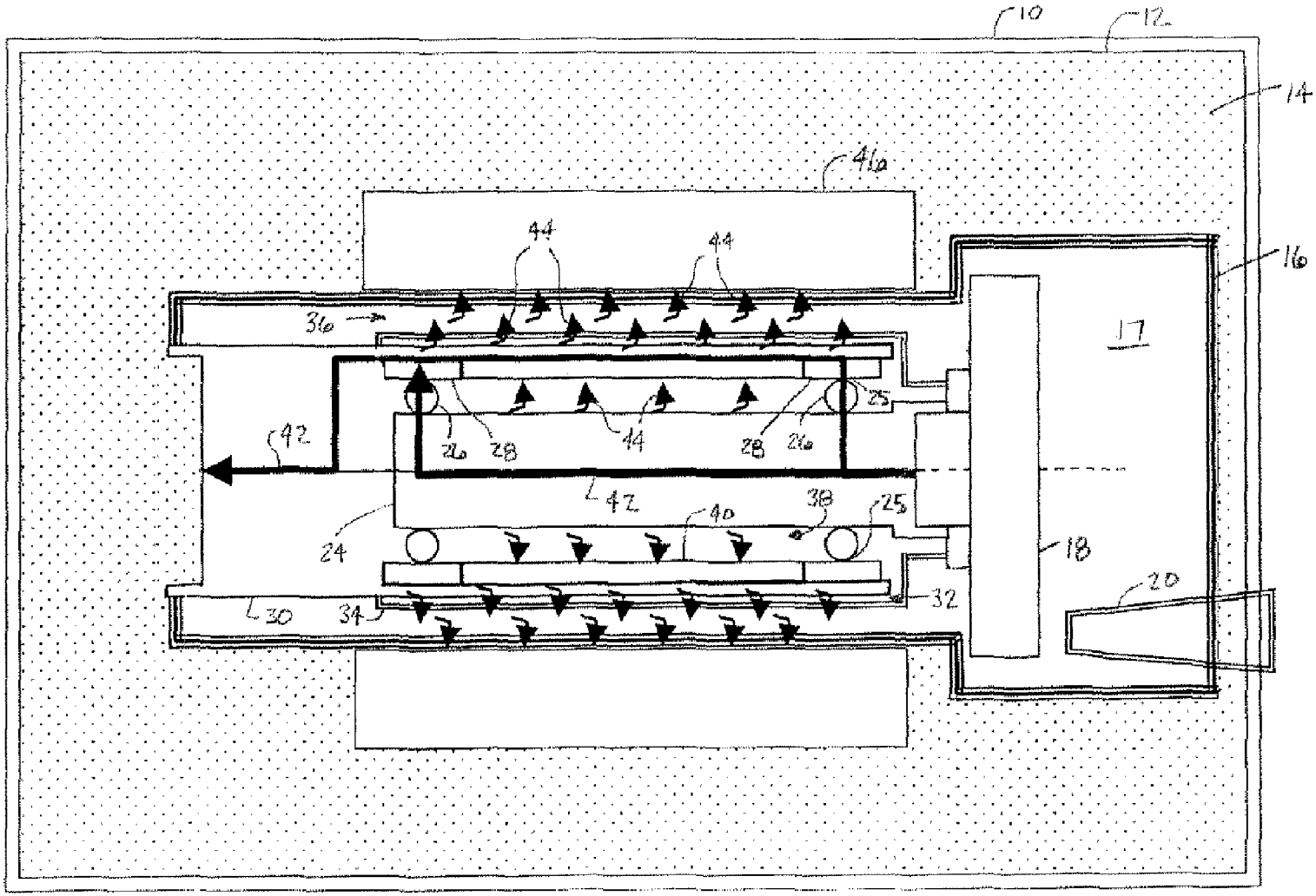
FIG. 1 is a cross-sectional block diagrammatic and schematic view of a traditional x-ray tube assembly.

Referring now to FIG. 1, a cross-sectional block diagrammatic and schematic view of a traditional x-ray tube assembly 10 is shown. The x-ray tube assembly 10 includes an insert 12 that is in the form of a reservoir and contains oil 14. The oil 14 is circulated through the insert 12 to cool an x-ray tube frame 16 contained therein. The frame 16 has a vacuum chamber 17 with a rotating anode 18 and a stationary cathode 20 that reside therein. The anode 18 is coupled to a shaft 24 that rotates on a set of bearings 25. The bearings 25 include bearing balls 26 and bearing outer race 28, bearing inner race (not shown) are integral with the shaft 24. The bearing balls 25 are held and supported within the bearing race.

Thermal energy transfers conductively from the anode 18, through the shaft 24, through the bearing balls 26 and the bearing race 28, and into a stationary bearing housing 30. From the bearing housing 30 the thermal energy radiates through a first portion 32 of the vacuum chamber 17, which resides within a motor rotor 34, and into the motor rotor 34. Box 46 represents the stator of the motor, which causes rotation of the rotor 34. From the motor rotor 34 the thermal energy radiates through a second portion 36 of the vacuum chamber 17, which is exterior to the motor rotor 34, and into the frame 16.

Additional thermal energy also radiates from the shaft 24 through a third portion 38 of the vacuum chamber 17, which resides between the shaft 24 and the bearing housing 30 or an element 40 attached thereto. Similarly and as stated above, from the bearing housing 30, the additional thermal energy passes through the first portion 32, the motor rotor 34, the second portion 36, and into the frame 16. A substantial amount of the above-mentioned thermal energy that resides within the frame is passed into the oil 14. The oil 14 is circulated and cooled via a heat exchanger and an external chiller (both of which are not shown).

Some thermal energy is also passed through the shaft 24 into the bearing housing 30, which is cooled by the oil 14. The thermal conduction paths for the above-stated is represented by arrows 42. The thermal radiation described above is represented by arrows 44.

The bearing balls 26 are conventionally solid lubricated with silver or lead. This method of lubricating and cooling the bearings is inadequate for increased gantry rotating speeds and increased peak and average operating powers. The present invention overcomes this and other limitations with existing x-ray tube rotating anode bearing configurations and is described in detail below.

In the following Figures the same reference numerals will be used to refer to the same components. While the present invention is primarily described with respect to a system for cooling the bearings of a rotating anode within an x-ray tube of a computed tomography (CT) system, the present invention may be adapted and applied to various systems including x-ray systems, Mammography systems, Vascular systems, Surgical-C systems, Radiographic (RAD) systems, RAD and Fluoroscopy Systems, and other known modalities including mixed modalities, such as CT-positron emission tomography (PET) or CT-Nuclear.

In the following description, various operating parameters and components are described for one constructed embodiment. These specific parameters and components are included as examples and are not meant to be limiting.

Figure 2:
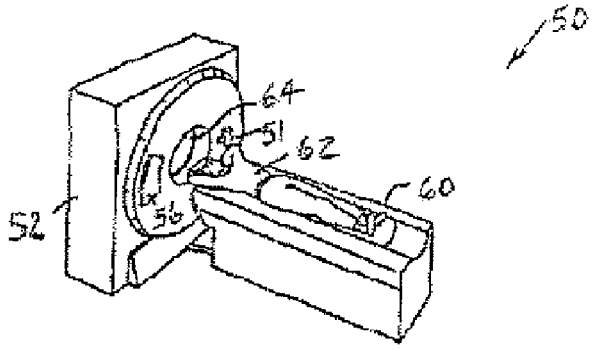
FIG. 2 is a perspective view of a CT imaging system incorporating an x-ray tube assembly in accordance with an embodiment of the present invention.
Figure 3:
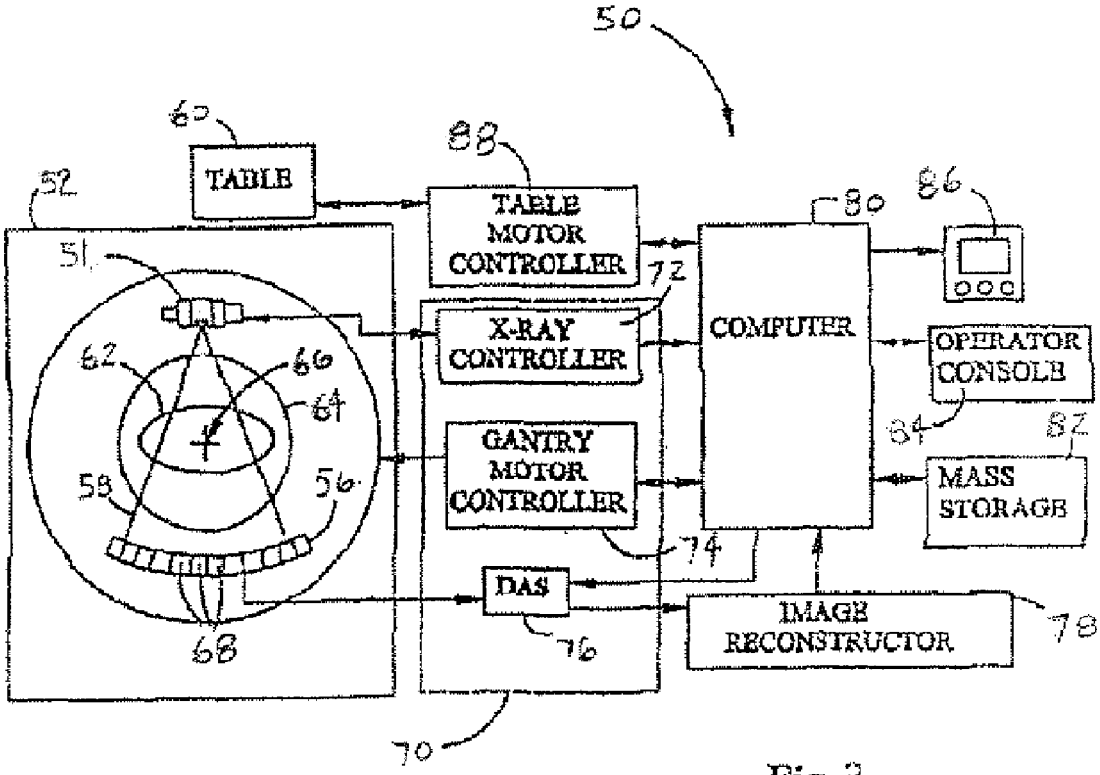
FIG. 3 is a schematic block diagrammatic view of the CT imaging system in accordance with an embodiment of the present invention.

Referring now to FIGS. 2 and 3, perspective and schematic block diagrammatic views of a CT imaging system 50 incorporating an x-ray source or an x-ray tube assembly 51 are shown in accordance with an embodiment of the present invention. The imaging system 50 includes a gantry 52 that has the x-ray tube assembly 51, and a detector array 56. The tube assembly 51 projects a beam of x-rays 58 towards the detector array 56. The tube assembly 51 and the detector array 56 rotate about an operably translatable table 60. The table 60 is translated along a z-axis between the tube assembly 51 and the detector array 56 to perform a helical scan. The beam 58 after passing through the medical patient 62, within the patient bore 64, is detected at the detector array 56. The detector array 56 upon receiving the beam 58 generates projection data that is used to create a CT image.

The x-ray tube assembly 51 and the detector array 56 rotate about a center axis 66. The beam 58 is received by multiple detector elements 68. Each detector element 68 generates an electrical signal that corresponds to the intensity of the impinging x-ray beam 58. As the beam 58 passes through the patient 62 the beam 58 is attenuated. Rotation of the gantry 52 and the operation of x-ray tube assembly 51 are governed by a control mechanism 70. The control mechanism 70 includes an x-ray controller 72 that provides power and timing signals to the x-ray tube assembly 51 and a gantry motor controller 74 that controls the rotational speed and position of the gantry 52. A data acquisition system (DAS) 76 samples the analog data, generated from the detector elements 68, and converts the analog data into digital signals for the subsequent processing thereof. An image reconstructor 78 receives the sampled and digitized x-ray data from the DAS 76 and performs high-speed image reconstruction to generate the CT image. A main controller or computer 80 stores the CT image in a mass storage device 82.

The computer 80 also receives commands and scanning parameters from an operator via an operator console 84. A display 86 allows the operator to observe the reconstructed image and other data from the computer 80. The operator supplied commands and parameters are used by the computer 80 in operation of the control mechanism 70. In addition, the computer 80 operates a table motor controller 88, which translates the table 60 to position the patient 62 in the gantry 52.

Figure 4:
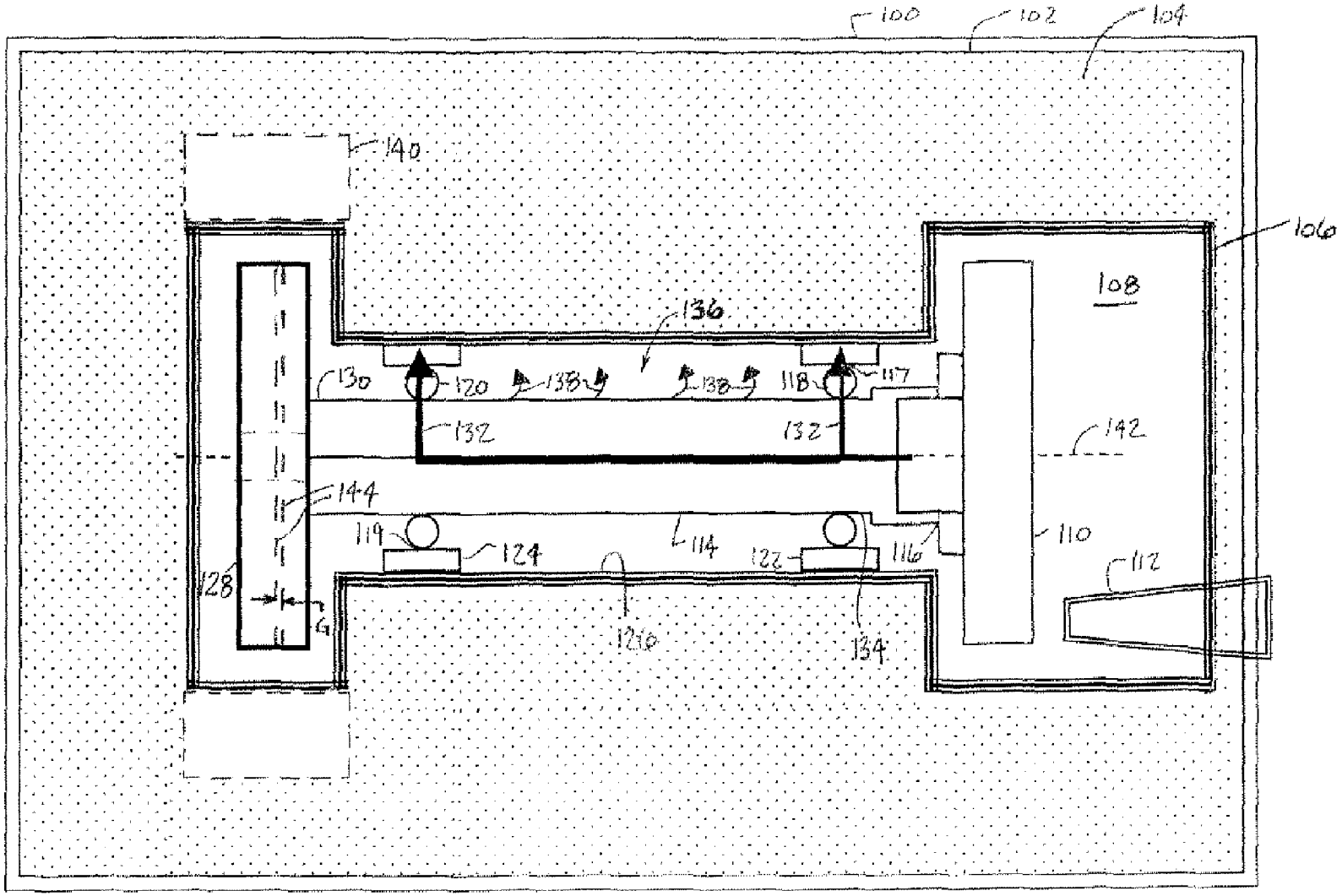
FIG. 4 is a cross-sectional block diagrammatic and schematic view of an x-ray tube assembly in accordance with an embodiment of the present invention.

Referring now to FIG. 4, a cross-sectional block diagrammatic and schematic view of an x-ray tube assembly 100 in accordance with an embodiment of the present invention is shown. The x-ray tube assembly 100 includes an insert 102 that is in the form of or contains a coolant reservoir with coolant 104 therein. The coolant may be in the form of oil or other coolant known in the art. A bearing housing or frame 106 resides within the coolant 104 and is thermally cooled therefrom utilizing techniques known in the art. The frame 106 encases a vacuum chamber 108, in which resides a rotating anode 110 and a stationary cathode 112. The anode 110 is attached to a shaft 114 via a hub 116. The shaft 114 resides within the vacuum chamber 108 and rotates on a first set of bearings 117 with bearing balls 118 and on a second set of bearings 119 with bearing balls 120. The bearing balls 118 and 120 are held in position and supported by a first bearing outer race 122 and a second bearing outer race 124, respectively. The bearing balls 118 and 120 are also held and supported by bearing inner race (not shown) that may be an integral part of the shaft 24. The bearing race 122 and 124 are attached to an interior surface 126 of the frame 106. One or more motor components, represented by box 128, are attached to and are used to rotate an aft end 130 of the shaft 114 (only the stator and rotor of the motor are shown). The motor components 128 also reside within the vacuum chamber 108.

Thermal energy within the anode 110 is conductively passed directly through the hub 116, the shaft 114, the bearing balls 118 and 120, and the bearing race 122 and 124 to the frame 106. This thermal energy transfer is in the form of a single continuous conductive thermal energy path, as represented by arrows 132.

The first set of bearing balls 118 are mounted on the fore end 134 of the shaft 114 near the hub 116. The second set of bearing balls 120 are mounted on the aft end 130 of the shaft 114 near the motor component(s) 128. The bearing balls 118 and 120 and the bearing race 122 and 124 may be solid lubricated using silver or lead, as known in the art. Due to the direct coupling of the bearings 117 and 119 to the frame 106, the bearings 117 and 119 are efficiently cooled by the coolant 104. This allows for increased peak and average powers over that of the x-ray tube assembly 10 of FIG. 1 and increased operating life of the bearings 117 and 119. The bearing outer races 122 and 124 may be integral with, coupled to, or attached to the frame 106.

Note also that since the frame 106 is in essence the housing of the bearings 117 and 119, a larger surface area of the bearing housing is in contact with the coolant 104, which increases the convective heat transfer between the frame 106 and the coolant 104. Thermal energy is also radiated from the shaft 114 to a vacuum area 136 between the first bearing set 118 and the second bearing set 120 to the frame 106, as represented by arrows 138. The radiated thermal energy 138 passes through only a single vacuum area, as opposed to the radiated thermal energy 44 within the x-ray tube assembly 10.

Although a specific style of bearings and bearing race are shown, various bearings and bearing race may be utilized. Thus, ball bearings held within a bearing channel of a bearings race, as shown, roller bearings, or other shaft rolling element bearings and/or bearing race known in the art may be utilized.

The motor (all of which not shown) may be a radial flux motor or an axial flux motor, with a motor rotor, a motor stator, or other motor components known in the art. When a traditional style radial flux electrical motor is utilized in which a rotor is rotated within a stator, box 128 represents a rotor and dashed box 140 represents a stator. When an axial flux motor is utilized, both the motor rotor and the motor stator may reside in the vacuum 108, and thus box 128 represents the combination of both the stator and the rotor. In the axial flux embodiment the stator and the rotor are rotating in parallel about a center axis 142. Dashed lines 144 are shown to illustrate the air gap G between the stator and the rotor of an axial flux motor. The stator 140 is not utilized when an axial flux motor is used. An axial flux motor with a motor stator adjacent and external to the vacuum chamber and a motor rotor inside the vacuum chamber may also be utilized. In this last sample embodiment, box 128 represents only the axial flux motor rotor.

In coupling the motor components 128 on the aft end 130 as opposed to some position along the shaft 114, the motor components 128 are farther away from the anode 110, which decreases the operating temperature of the motor components 128. This decrease in operating temperature also allows for increased rotating speeds of the anode 110 and increases the operating life of the motor.

Figure 5:
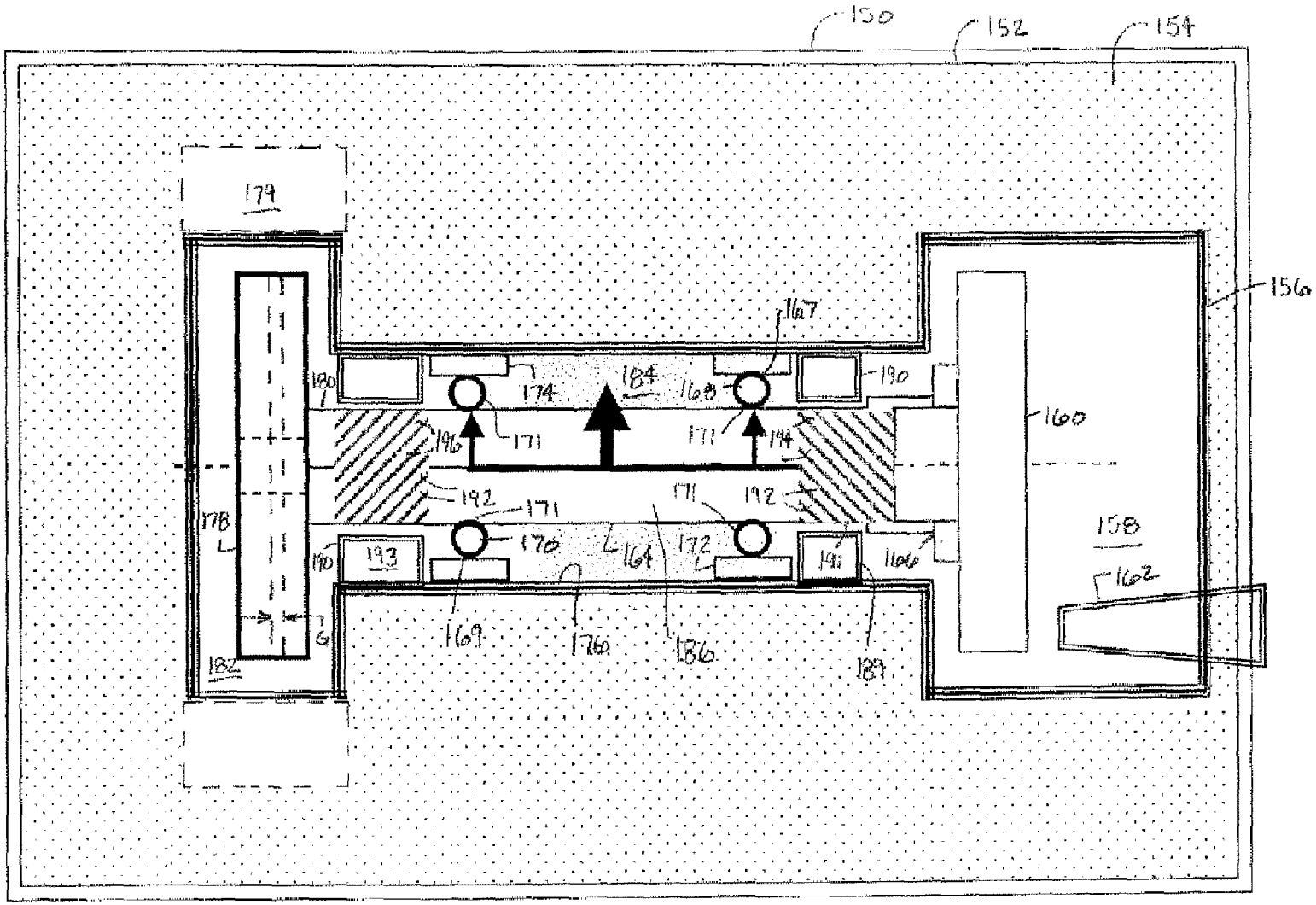
FIG. 5 is a cross-sectional block diagrammatic and schematic view of an x-ray tube assembly in accordance with another embodiment of the present invention.

Referring now to FIG. 5, a cross-sectional block diagrammatic and schematic view of an x-ray tube assembly 150 in accordance with another embodiment of the present invention is shown. The x-ray tube assembly 150, like the x-ray tube assembly 100, includes an insert 152 that is in the form of or contains a coolant reservoir with coolant 154 therein. A bearing housing or frame 156 resides within the coolant 154 and is thermally cooled therefrom utilizing techniques known in the art. The frame 156 encases a first vacuum chamber 158 in which resides a rotating anode 160 and a stationary cathode 162. The anode 160 is attached to a shaft 164 via a hub 166. The shaft 164 rotates on a first set of bearings 167 and on a second set of bearings 169. The bearings 167 and 169 have bearing balls 168 and 170 and bearing outer race 172 and 174, respectively. The bearing balls 168 and 170 are held in position and supported by the first bearing outer race 172 and the second bearing outer race 174, respectively. The bearing race 172 and 174 are attached to an interior surface 176 of the frame 156. One or more motor components 178 are attached to an aft end 180 of the shaft 164 and also reside within the first vacuum chamber 158 or a separate or second vacuum chamber 182, as shown. When a traditional style electric motor is utilized, box 179 represents a stator.

However, unlike the x-ray tube assembly 100, the shaft 164, of the x-ray tube assembly 150, resides partially within the vacuum chambers 158 and 182 and within a grease-lubricated and liquid metal cooled bearing area 184, which essentially comprises of vacuum grease around the bearing balls 168 and 170 for lubrication and liquid metal between the bearing sets 168 and 170 and around a center portion 186 of the shaft 164 for cooling. The vacuum grease is represented by thick dark circles 171. The area 184 surrounds a center portion 186 of the shaft 164. The bearing balls 168 and 170 and the bearing race 172 and 174 are similar to the bearing balls 118 and 120 and the bearing race 122 and 124. The bearing balls 168 and 170 and the bearing race 172 and 174 reside within the area 184 and are lubricated and cooled by the material substances contained therein.

In one embodiment of the present invention, the material substances within the area 184 include vacuum grease and gallium and/or a gallium alloy. The concentration of gallium/gallium alloy may vary per application. The gallium/gallium alloy is in the form of a liquid metal and has associated cooling characteristics as well as lubricating characteristics. The use of vacuum grease provides a bearing lubricant that can operate in the elastohydrodynamic regime, which in turn allows the bearings 167 and 169 to operate at low friction levels. This further increases the allowable gantry rotating speeds, the allowable rotating speeds of the anode 160, and the operating life of the bearings 167 and 169.

A continuous thermal conductive energy medium consisting of the hub 166, the shaft 164, the bearing balls 168 and 170, and the bearing race 172 and 174 exists between the anode 160 and the frame 156. In addition, with the addition of the area 184, thermal energy is also conductively passed from the shaft 164 through the material substances contained within the area 184 to the frame 156. The area 184 increases the thermal conductive surface area between the shaft 164 and the frame 156 for increased thermal energy transfer efficiency.

Clearance seals 190 reside between and separate the vacuum chambers 158 and 182 from the area 184. The seals 190 reside on the interior surface 176 of the frame with a substantially small or tight clearance between the seals 190 and the shaft 164. This clearance is of the order of a few microns, for example, in one embodiment of the present invention this clearance is approximately 30 microns. The small clearance and high surface tension of the liquid metal prevent the vacuum grease lubricant and the liquid metal coolant within the area 184 from entering the vacuum chambers 158 and 182. The liquid metal coolant may be of high density to serve as a seal for vacuum grease vapors, when generated, from diffusing into the vacuum chambers 158 and 182. A first seal 189 resides on a fore end 191 of the shaft 164. A second seal 193 resides on the aft end 180. The seals 190 are capable of withstanding the environment within the frame 156 and may be of various types and styles known in the art.

To further prevent the liquid metal coolant or grease lubricant within the area 184 from entering the vacuum chambers 158 and 182, the shaft 164 may include grooves 192 that direct or force the coolant and/or lubricant within the clearance between the seals 190 and the shaft 164 away from the vacuum chambers 152 and 182. The configuration of the grooves 192 and the rotation of the shaft 164 force the liquid metal and the grease into the area 184. In the embodiment shown a first set of spiral grooves 194 resides on the fore end 191 in alignment with the first seal 189, and a second set of spiral grooves 196 resides on the aft end 180 in alignment with the second seal 193. The first set of grooves 194 is oriented opposite the second set of grooves 196 to prevent flow of liquid metal and grease into the first chamber 158 and into the second chamber 182, respectively.

The motor (not all of which is shown) of the x-ray tube assembly 150 may be a radial flux motor or an axial flux motor and the components 178 thereof, like the motor components 128, may include a motor rotor, a motor stator, or other motor components known in the art. Since the motor components 178 are coupled to the aft end 180, the motor components 178 operate at reduced operating temperatures. This decrease in operating temperatures also allows for increased rotating speeds of the anode 160 and increased operating life of the motor (all components of the motor are not shown).

The use of gallium/gallium alloy in the area 184 provides a thermal shunt and reduces thermal gradients between the shaft 164 and the bearing race 172 and 174, thereby eliminating the need for thermal compensation. Thermal compensation refers to the effect of axial and radial play in the bearings due to relative expansion from heating, which is minimized because of reduced thermal gradients between the shaft 164 and the bearing race 172 and 174. The use of gallium/gallium alloy as a thermal shunt and the reduced operating temperatures of the anode 160, the shaft 164, the motor components 178, and especially the bearings 168 and 170 allows for the use of vacuum grease as the bearing lubricant within the frame 156. The reduced operating temperatures prevent the evaporation of and allow for the use of vacuum grease within the area 184 for lubrication of the bearings 168 and 170.

Figure 6:
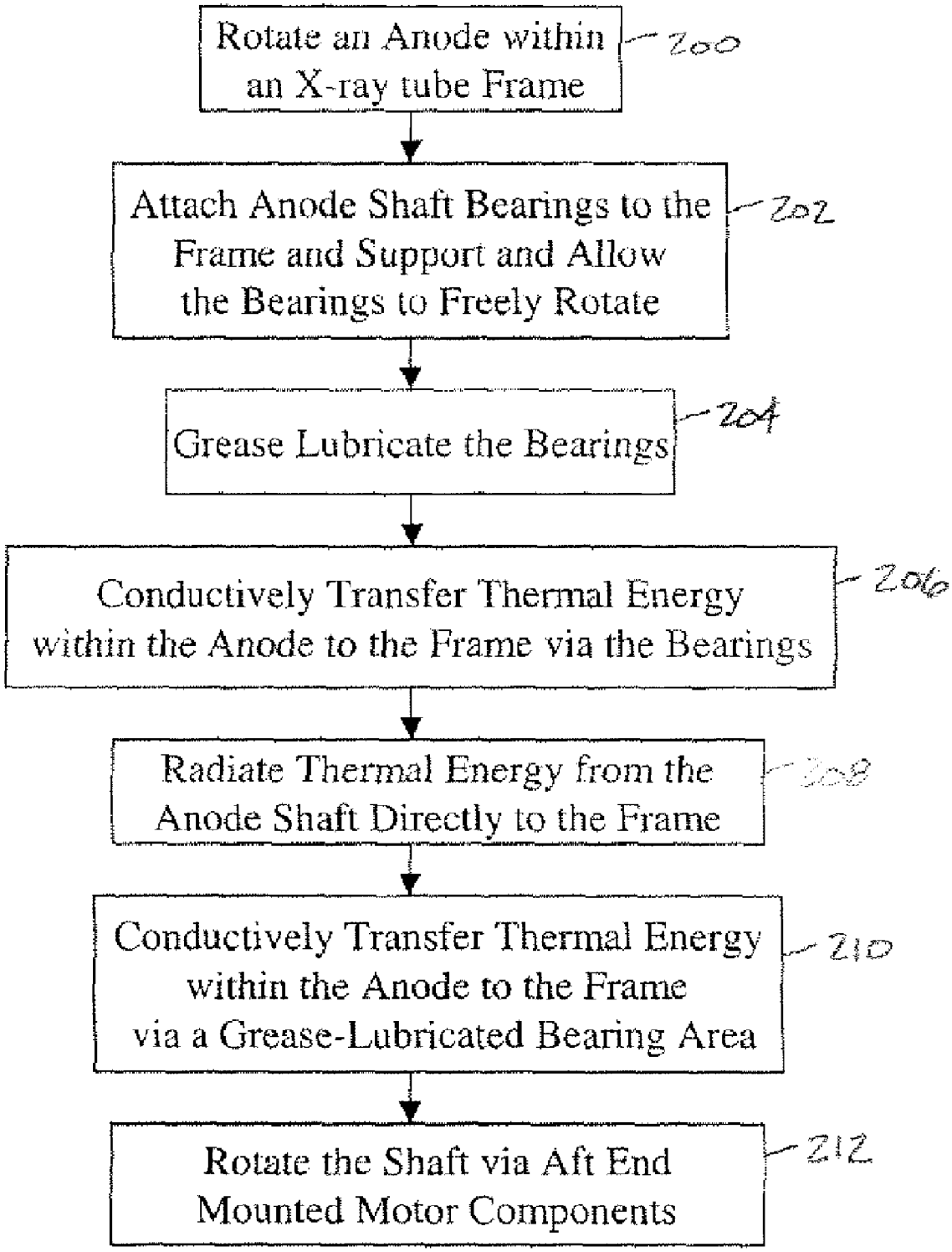
FIG. 6 is a method of operating an x-ray tube assembly in accordance with another embodiment of the present invention.

Referring now to FIG. 6, a method of operating an x-ray tube assembly, such as one of the assemblies 100 and 150, in accordance with another embodiment of the present invention is shown.

In step 200, an anode, such as one of the anodes 110 and 160, is rotated within a stationary frame, such as one of the frames 106 and 156. The anode is rotated via a shaft, such as one of the shafts 114 and 164, on one or more bearings, such as the bearing sets 117, 119, 167, and 169.

In step 202, the bearing balls are supported and rotated on the shaft 164 via one or more bearing outer race, such as bearing race 122, 124, 172, and 174. The bearing outer race are attached to an interior surface of the x-ray tube frame, such as to the interior surfaces 126 and 176. In step 204, the bearing balls and the bearing race may be grease lubricated and reside within a grease-lubricated liquid metal cooled area, such as area 184. The bearing balls and the bearing race may reside, as stated above, within vacuum grease containing a liquid metal, such as gallium, a gallium alloy, or the like.

In step 206, thermal energy is transferred through a continuous conductive thermal energy medium from the anode to the frame. The thermal energy is conductively transferred through a hub, such as one of the hubs 116 and 166, the shaft, the bearing balls, and the bearing race to the x-ray tube frame. In step 208, thermal energy may also be radiated from the shaft directly to the frame through only a single vacuum stage or portion of a vacuum chamber, such as vacuum area 136. In step 210, thermal energy may also be conductively transferred directly, via the grease-lubricated liquid metal cooled area, from the shaft to the x-ray tube frame. In steps 206, 208, and 210 thermal energy is transferred from the anode to an exterior side of the frame through a non-motor component transfer medium. In step 206 and 210 thermal energy is non-radiatively transferred from the anode to coolant, such the coolant 104 or 154, exterior the frame.

In step 212, the shaft is rotated via a shaft aft end mounted motor, such as that represented by motor components 128 and 178 and stators 140 and 179. The shaft may be rotated via a traditional style electrical motor or an axial flux motor.

The above-described steps are meant to be illustrative examples; the steps may be performed sequentially, synchronously, simultaneously, or in a different order depending upon the application.

The present invention provides x-ray tube assemblies with increased cooling efficiency and x-ray tube component service life. The x-ray tube assemblies allow for increased gantry rotating speeds and increased x-ray tube peak and average power requirements. The increase in gantry rotating speeds and x-ray tube peak operating power provides quicker imaging times and improved image quality.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A rotating anode bearing housing comprising:

an x-ray tube frame having a vacuum chamber; and an anode residing within said vacuum chamber and rotating on a shaft via a plurality of bearings;

said plurality of bearings radially and directly attached to an interior surface of said x-ray tube frame, transferring thermal energy from said shaft to said x-ray tube frame, and comprising;

a first bearing mounted forward on said shaft and proximate said anode; and a second bearing mounted aft of said first bearing on said shaft and forward of a motor rotor.

2. A housing as in claim 1 wherein said shaft, said at least one bearing, and said frame form a continuous non-fluid based thermal energy transfer medium between said anode and an exterior side of said frame.

3. A housing as in claim 1 wherein said shaft, said at least one bearing, and said frame form a continuous conduction non-fluid based thermal energy transfer medium between said anode and an exterior side of said frame.

4. A housing as in claim 1 comprising said motor rotor, said motor rotor coupled to an aft end of said shaft.

5. A housing as in claim 4 wherein said motor rotor rotates within a stator.

6. A housing as in claim 1 further comprising at least one seal coupled between at least one of said plurality of bearings and said said vacuum chamber.

7. A housing as in claim 1 further comprising a grease-lubricated liquid metal cooled area surrounding said plurality of bearings and separated from said vacuum chamber.

8. A housing as in claim 7 wherein said grease-lubricated liquid metal cooled area comprises vacuum grease.

9. A housing as in claim 7 wherein said grease-lubricated liquid metal cooled area comprises at least one of gallium and a gallium alloy.

10. A housing as in claim 1 wherein said plurality of bearings is lubricated with a vacuum grease and cooled with a liquid metal.

11. A housing as in claim 1 wherein said shaft is cooled with a liquid metal.

12. A housing as in claim 1 wherein said shaft comprises at least one set of spiral grooves preventing a coolant and a lubricant from entering said vacuum chamber.

13. A housing as in claim 12 wherein said at least one set of spiral grooves comprises:

a first set of spiral grooves preventing flow of lubricant and coolant towards said anode; and a second set of spiral grooves preventing flow of lubricant and coolant towards a motor rotor.

14. An imaging tube assembly comprising:

an insert at least partially filled with a coolant;

an x-ray tube frame residing within said insert and having a vacuum chamber;

an anode residing within said vacuum chamber and rotating on a shaft via a plurality of bearings mounted along said shaft; and a liquid metal cooling area surrounding said plurality of bearings, having a liquid metal, and defined and abutted by said x-ray tube frame and said shaft;

said plurality of bearings attached to an interior surface of said x-ray tube frame and transferring thermal energy from said shaft to said x-ray tube frame.

15. A imaging tube as in claim 14 wherein said coolant comprises oil.

16. An imaging tube as in claim 14 wherein said shaft, said plurality of bearings, and said frame form a continuous conduction non-fluid based thermal energy transfer medium between said anode and said coolant.

17. An imaging tube as in claim 14 further comprising:

a grease-lubricated liquid metal cooled area surrounding said at least one bearing;

at least one coupled between said plurality of bearings and said vacuum chamber and preventing a grease and a liquid metal coolant within said grease-lubricated liquid metal cooled area from entering said vacuum chamber; and at least one set of shaft grooves further preventing said grease from entering said vacuum chamber.

18. A method of operating an imaging tube comprising:

rotating an anode within a stationary frame via a shaft on a plurality of bearing balls mounted along said shaft;

preventing a coolant and a lubricant from leaving a cooling area between said plurality of bearing balls and entering a vacuum chamber via at least one set of spiral grooves on said shaft;

supporting and allowing said plurality of bearing balls to rotate on said shaft via at least one bearing race attached to an interior surface of said x-ray tube frame; and transferring thermal energy from said plurality of bearing balls to said x-ray tube frame through said cooling area and said at least one bearing race.

19. A method as in claim 18 further comprising transferring thermal energy from said anode to an exterior side of said frame through a non-motor component transfer medium.

20. A method as in claim 18 wherein further comprising non-radiatively transferring thermal energy from said anode to coolant exterior said frame.

21. A housing as in claim 1 further comprising a grease-lubricated liquid metal cooled area between and surrounding said plurality of bearings and separated from said vacuum chamber.

22. An imaging tube as in claim 14 further comprising:

a grease-lubricated liquid metal cooled area surrounding said plurality of bearings; and at least one seal coupled between said plurality of bearings and said vacuum chamber, between said shaft and said frame, and preventing a grease and a liquid metal coolant within said grease-lubricated liquid metal cooled area from entering said vacuum chamber.

* * * * *